US005334014A

United States Patent [19]

Orbeck et al.

[11] Patent Number: 5,334,014

[45] Date of Patent: Aug. 2, 1994

[54] WALKING BEAM FURNACE

[75] Inventors: Gary A. Orbeck, Windham, N.H.; Arthur Waugh, Winchester, Mass.

[73] Assignee: BTU International, No. Billerica, Mass.

[21] Appl. No.: 39,915

[22] Filed: Mar. 30, 1993

[51] Int. Cl.[5] ..... F27B 9/00

[52] U.S. Cl. ..... 432/121; 432/122; 432/124

[58] Field of Search ..... 432/5, 6, 121, 122, 432/241, 124

[56] References Cited

U.S. PATENT DOCUMENTS

| | | | |
|---|---|---|---|
| 3,811,825 | 5/1974 | Enderlein | 432/122 |
| 4,556,385 | 12/1985 | Denis | 432/122 |
| 4,609,347 | 9/1986 | Yamashita et al. | 432/234 |
| 4,917,600 | 4/1990 | White | 432/121 |

*Primary Examiner*—Henry C. Yuen
*Attorney, Agent, or Firm*—Weingarten, Schurgin, Gagnebin & Hayes

[57] ABSTRACT

A walking beam furnace is provided for moving a work product through a high temperature (1,600° C.) furnace at high speed in large horizontal increments. A monolithic walking beam mechanism, including an array of parallel beams and support therefor, fabricated entirely from a refractory material such as silicon carbide (SIC), provides a movable, planar hearth surface. A fixed array of longitudinally disposed, spaced-apart hearth members, provides a fixed, planar hearth surface. The beams are narrower than the spacing between the hearth members to permit passage of the ,array of beams in coplanar alignment with the fixed hearth members through the spacing between the hearth members. The beams of the walking beam mechanism and the fixed hearth members alternately support the work product so that the work product is conveyed by the beams in an incremental fashion without sliding the work product along the hearth members during a continuous cycle of raising the monolithic beam support, moving it forward, lowering it, retracting it, and raising it again.

17 Claims, 4 Drawing Sheets

WALKING BEAM FURNACE

FIELD OF THE INVENTION

This invention relates to furnaces, and more particularly to a walking beam mechanism for transporting a work product through a high temperature furnace.

BACKGROUND OF THE INVENTION

Walking beam furnaces are known for providing rectilinear motion of a work product through a furnace chamber in an incremental or step-wise manner. This substantially frictionless transport mechanism minimizes particle generation resulting from abrasion commonly encountered in pushing or sliding type transport devices. The distance a work product is moved through a furnace environment is related to the distance the beam or beams is advanced in each forward increment.

For a variety of reasons, including cost and ease of manufacture, walking beam mechanisms are commonly made from metals able to withstand ordinary furnace temperatures. However, process steps requiring extremely high temperatures exceed the material limits of ordinary metal furnace components which are susceptible to deformation or failure at these elevated temperatures. Additionally, certain thermal treatments require rapid transition of a work product from one thermal zone to another. However, the thermal shock encountered by the walking beam components that move with the work product can cause failure of beam components.

To surmount the limitations of ordinary metal furnace components, ceramic materials are commonly used in high-temperature structures. "High-temperatures" are generally defined as being above 1,830° Fahrenheit (1,000° C.), or temperatures at which, because of melting or oxidation, common metals cannot be used. Ceramics known as refractories are products which are employed in the furnace art to thermally insulate furnaces that produce steel, aluminum and other metals. Refractories are commonly used in the steel industry where they are used for the lining of blast furnaces, open hearth furnaces, nonferrous metallurgical furnaces, ceramic kilns and the like. Common refractory materials include silicon carbide (SiC) and aluminum oxide (alumina). When objects made of refractory materials are configured as simple structures having few angular edges and bends, they can be rapidly transported from one thermal regime to another, e.g., from hot to cold, without suffering from material failure due to thermal shock. In addition to their high temperature tolerances these materials are also extremely hard.

Refractories are known for use with walking beam furnaces, as described in U.S. Pat. No. 4,446,385 to Denis, which discloses refractory walking beams positioned on crosspieces supported by uprights. However, neither the crosspieces nor the uprights of Denis are made of a refractory material because they are not subjected to the high temperatures that the walking beams are exposed to. Instead of providing support and movement elements that are extraordinarily heat tolerant, the Denis furnace isolates these components from extreme temperatures by heat conducting recesses or channels. These recesses direct heated gasses to provide a means for heating the underside of a work piece resting on the hearth without heating the support and movement elements. This configuration is an unnecessarily complex solution for ensuring uniform heating of the work product.

SUMMARY OF THE INVENTION

The present invention overcomes the disadvantages of the prior art by providing support and transport elements in a walking beam furnace that do not need to be isolated from a thermal processing zone. The walking beam furnace of the invention combines the advantages of high-speed, frictionless transport provided by a walking beam mechanism, with the temperature and strength properties of refractory materials to enable work product processing at high temperatures. Furthermore, because of the configuration of the beam support and transport mechanism, the walking beam mechanism is able to rapidly transport work products through disparate thermal zones without the walking beam mechanism failing from thermal shock, while ensuring uniform heating of the top, sides, and bottom of the work products.

In a present embodiment, a movable, monolithic walking beam mechanism includes a beam holder and an array of parallel beams providing a movable, planar hearth surface. The entire structure is fabricated from a refractory material such as silicon carbide (SIC) to withstand high furnace temperatures. A fixed array of longitudinally disposed, spaced-apart refractory material hearth members provides a fixed, planar hearth surface. The beams are narrower than the spacing between the fixed hearth members to permit passage of the array of beams in coplanar alignment with the fixed hearth members through the spacing between them.

DESCRIPTION OF THE DRAWINGS

The invention will be more fully understood from the following detailed description taken in conjunction with the accompany drawings in which.

DETAILED DESCRIPTION OF THE INVENTION

Figure 1:
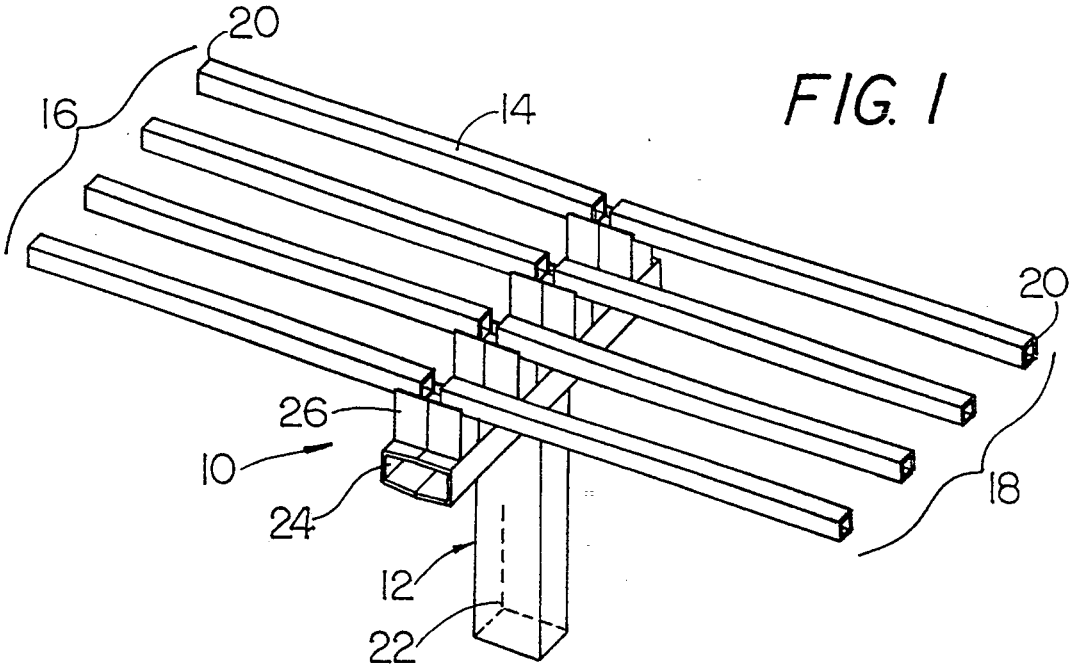
FIG. 1 is a perspective view of a walking beam mechanism of the invention.

Referring to FIG. 1, a monolithic walking beam mechanism 10 is shown having a beam support 12 and beams 14 positioned thereon. The entirety of the beam mechanism 10 is made of silicon carbide (SIC), such as Crystar (a trademark of Norton for recrystallized silicon carbide) which is capable of withstanding temperatures in excess of 1,600° C. Crystar not only becomes stronger with increasing temperature, but also withstands without failure rapid temperature transition from, for example, 1,500° C. to 1,000° C.

Figure 4:
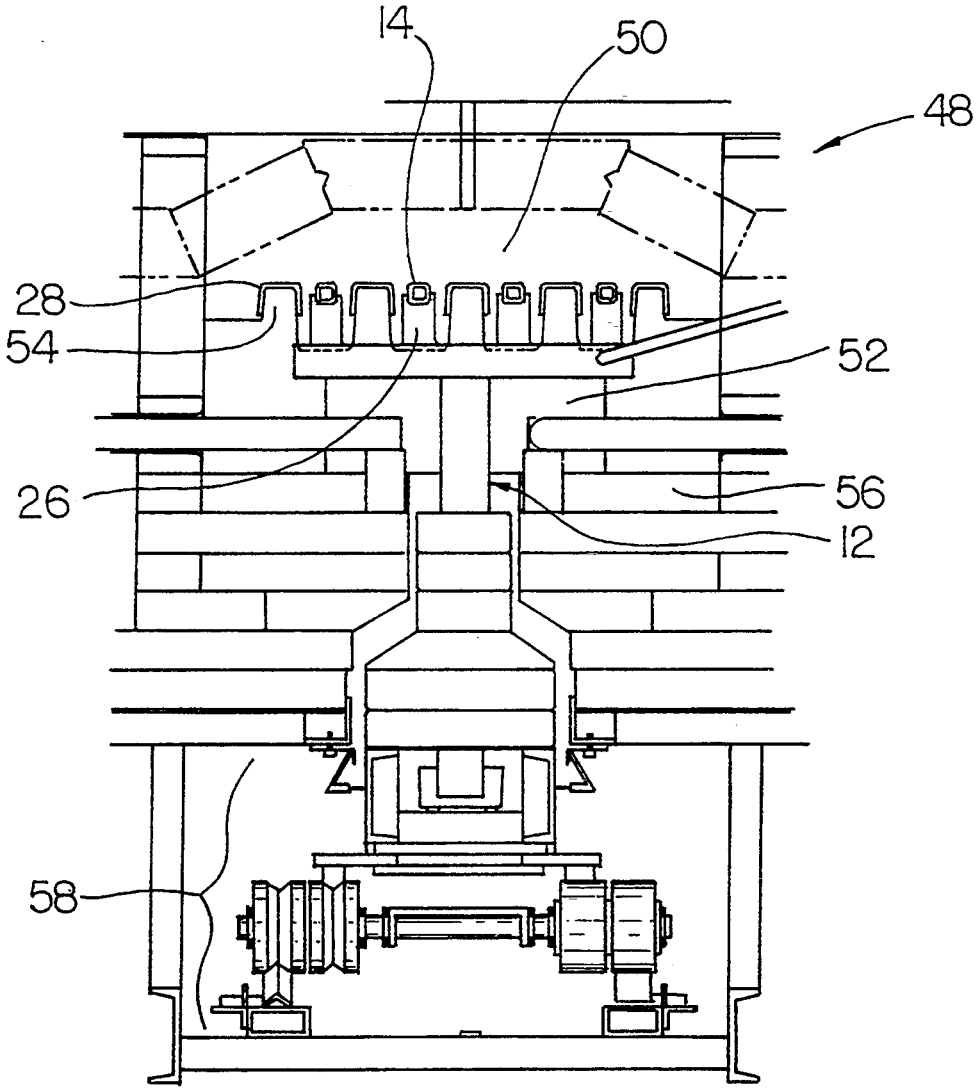
FIG. 4 is an end view of a furnace incorporating the walking beam mechanism of the invention.

The beam support 12 is coupled to a drive mechanism, illustrated in FIG. 4, for providing the impetus to move the beam support 12 both vertically and horizontally with respect to the plane formed by a movable hearth surface formed by the upper surfaces of the beams 14. The drive mechanism is responsive to an operator input device (not shown) for controlling furnace operation. The embodiment of the walking beam mechanism 10 of FIG. 1 is configured for moving a work product horizontally through a furnace (not shown) at approximately 60 inches per minute. However, the particular drive mechanism and control inputs thereto, enable the rate of movement to be regulated across a wide operating range as a function of the process requirements.

Figure 3:
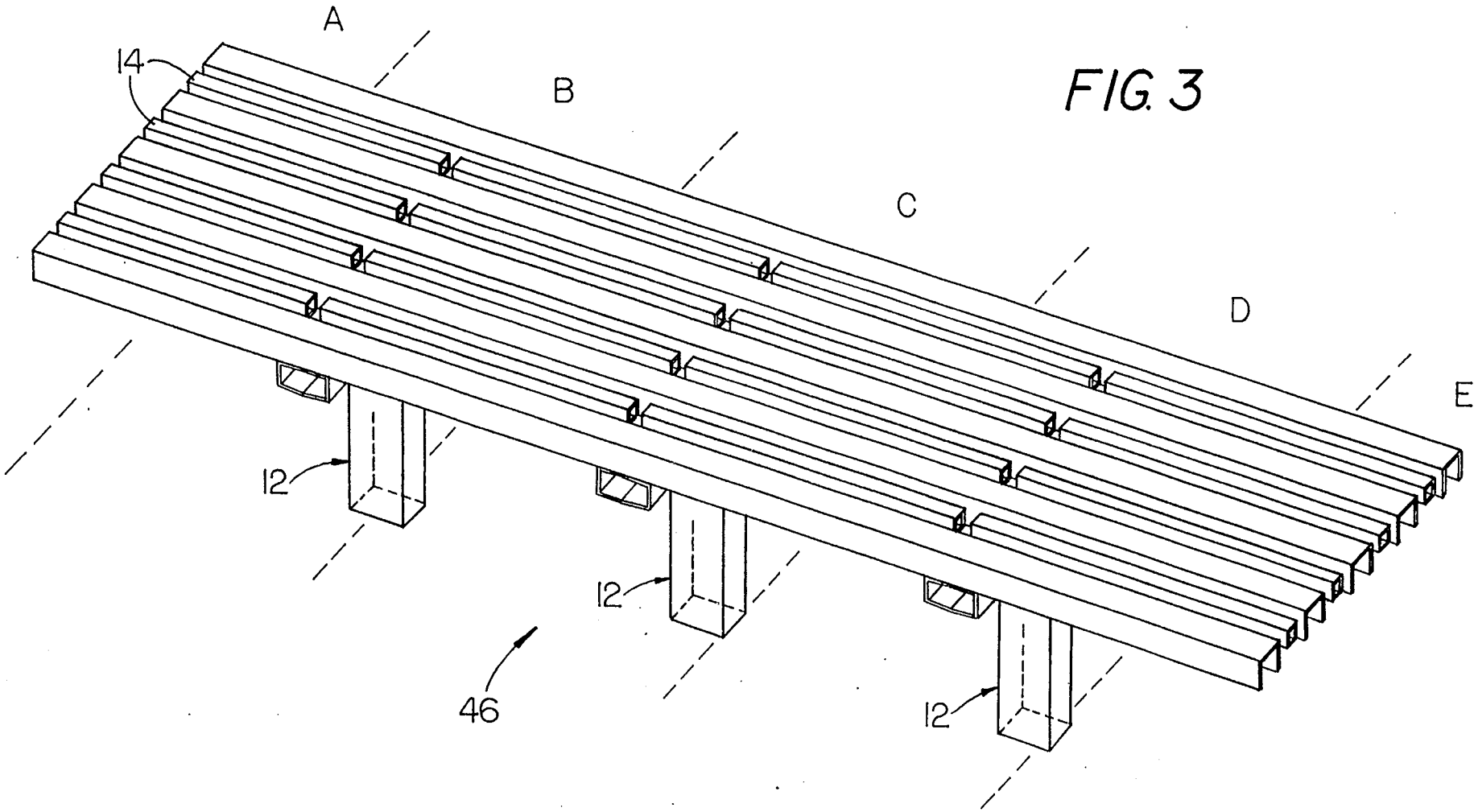
FIG. 3 is a perspective view of two walking beam mechanisms of the invention aligned for transporting a work product over an extended distance.

The walking beam mechanism 10 of FIG. 1 comprises a beam support 12 supporting a first and a second group of beams, 16 and 18 respectively, each group of beams comprising four hollow beams 14 or tubes. The distal end 20 of each beam 14 is supported by another beam support 12 in a similar manner as shown in FIG. 3. In this embodiment, the beams 14 are $1\frac{1}{4}'' \times 1\frac{1}{4}'' \times 120''$. However, a different number of beams 14 in each group 16, 18, as well as beams 14 having other dimensions, are contemplated to accommodate different size and weight work products, and various furnace widths and lengths. Beams 14 are hollow for strength and to reduce their thermal mass for efficient heating.

The beam support 12 is a single structure and includes a drive linkage, shown in FIG. 1 as a vertical column 22, adapted for engagement with the drive mechanism 58 (shown in FIG. 4); and a beam retainer 24 including positioning blocks 26 for aligning and retaining the beams 14. The width of the beam retainer 24 is adapted to receive the required number of beams 14 into a corresponding number of positioning blocks 26. Two longitudinally aligned beams 14, one from each group, are retained by a friction fit within each positioning block 26 for preventing unintended movement of the beams in relation to the beam support 12.

The column 22, retainer 24, and block 26 are formed of a refractory material such as silicon carbide and are preferable produced as a single unitary structure. This structure is capable of operating within the high temperatures unsuitable for conventional metal structures, and is also capable of withstanding the thermal shock encountered in moving between zones of widely different temperatures.

Figure 2:
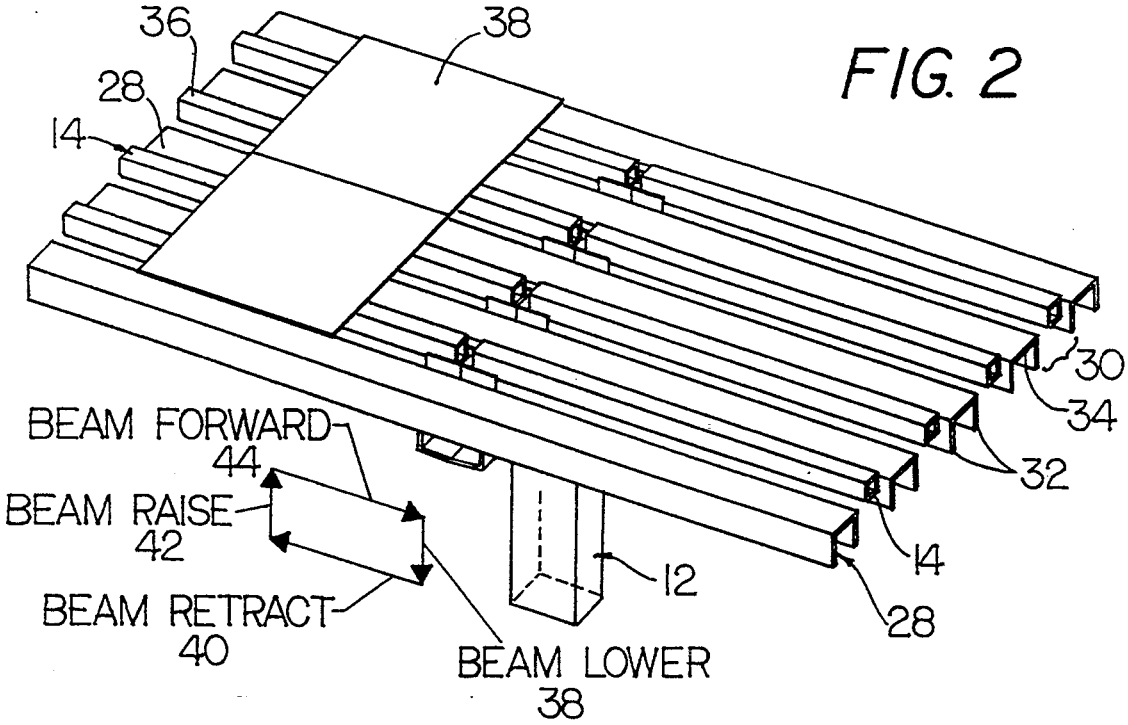
FIG. 2 is a perspective view of the walking beam mechanism of FIG. 1 integrated with fixed hearth members.

Referring to FIG. 2, the beams 14 are shown interleaved with hearth members 28. The hearth members 28 are supported independently from the walking beam mechanism 10 so as not to interfere with its movement, and form a fixed hearth defined by the plane of the upper surfaces of the hearth members 28. The hearth members 28 are aligned longitudinally and are separated from adjacent hearth members a distance sufficient to provide parallel channels 30 through which the beams 14 can pass without making frictional contact with the hearth members 28. The precise width of channels 30 is selected in relation to the width of beams 14 to provide passages intended for flow of furnace gases between the hearth members 28 and the beams 14. The hearth members 28 are of channel shape having downwardly projecting side elements 32 to strengthen them so as to allow a thin, single-wall support surface with a low thermal mass. Like the beams 14, the hearth members 28 are easily replaced if damaged or at the end of their normal life cycle. In this embodiment, the hearth members 28 are also made of a refractory such as silicon carbide.

The upper surface 36 of the beams 14 forms a planar, movable support surface, or movable hearth for the work product. For proper product transport, the movable hearth and fixed hearth are configured so that the planes formed by the movable hearth and the fixed hearth are parallel. The parallel disposition of the hearths also minimizes frictional engagement with the work product as the work product is transferred from one hearth to the other by raising or lowering the beams 14.

Conveyance of a work product 38 is accomplished by cyclical vertical and horizontal movement of the beam support 12, as shown by the arrows in FIG. 2, in the following manner. A work piece 38 is placed on the fixed hearth at a first location, such as at the entry to a furnace chamber, the movable hearth formed by the beams 14 being either coplanar or below the fixed hearth formed by the hearth members 28. If not already in a lowered position, the beam support is lowered to a predetermined level to disengage the beams 14 from the work product 38 which comes in contact with the hearth members 28. The beam support 12 is retracted 40 a predetermined distance, the work product 38 remaining immobile on the fixed hearth members 28. The beam support 12 is raised 42 a predetermined distance until the beams 14 engage the work product 38 and replace the fixed hearth members 28 as the sole means of support for the work product 38. The support beam 12 is then moved forward 44 in a rectilinear manner a predetermined increment thereby advancing the work product 38 to a different position within the furnace chamber. This cycle is repeated as necessary to transport the work product through the furnace. An operator controllable cycle speed determines the length of time required to transit thermal zones within the furnace.

Although the invention has been described with respect to the motion of a single walking beam mechanism 10, it should be understood that a plurality of walking beam mechanisms 10 can be joined or ganged to form a single extended length walking beam mechanism 46, as illustrated in FIG. 3, of desired overall length. As an example, the overall mechanism can be seventy or more feet in length. In this exemplary embodiment, three walking beam mechanisms 10 are joined to form the extended length walking beam mechanism 46 which is coupled to a drive mechanism (not shown). This configuration is especially useful for thermal processing of a work product in more than one thermal zone. FIG. 3 illustrates exemplary thermal zones labeled as A, B, C, D, and E, the means for establishing these zones being well known in the art. During operation, portions of the beams 14 transit back and forth between adjacent zones, whereas the beam support 12 remains in a single thermal zone.

Referring to FIG. 4, an end view of a walking beam furnace 48 is illustrated that incorporates the extended walking beam mechanism 46 of FIG. 3. This view depicts the exposure of the beams 14, retained within their respective positioning blocks 26, to an upper and a lower thermal environment, 50 and 52 respectively, that provide for independent top and bottom heating of a work product, in addition to or in lieu of disparate longitudinal thermal zones. The fixed hearth members 28 are mounted on alumina hearth supports 54 disposed between adjacent beam supports 12 and proximate the ends of the fixed hearth members 28. The hearth supports 54 are supported by the chamber floor 56. The beam support 12 is connected to a drive mechanism 58 known in the art. A similar configuration is used when the furnace 48 incorporates a single walking beam mechanism 10.

Figure 5:
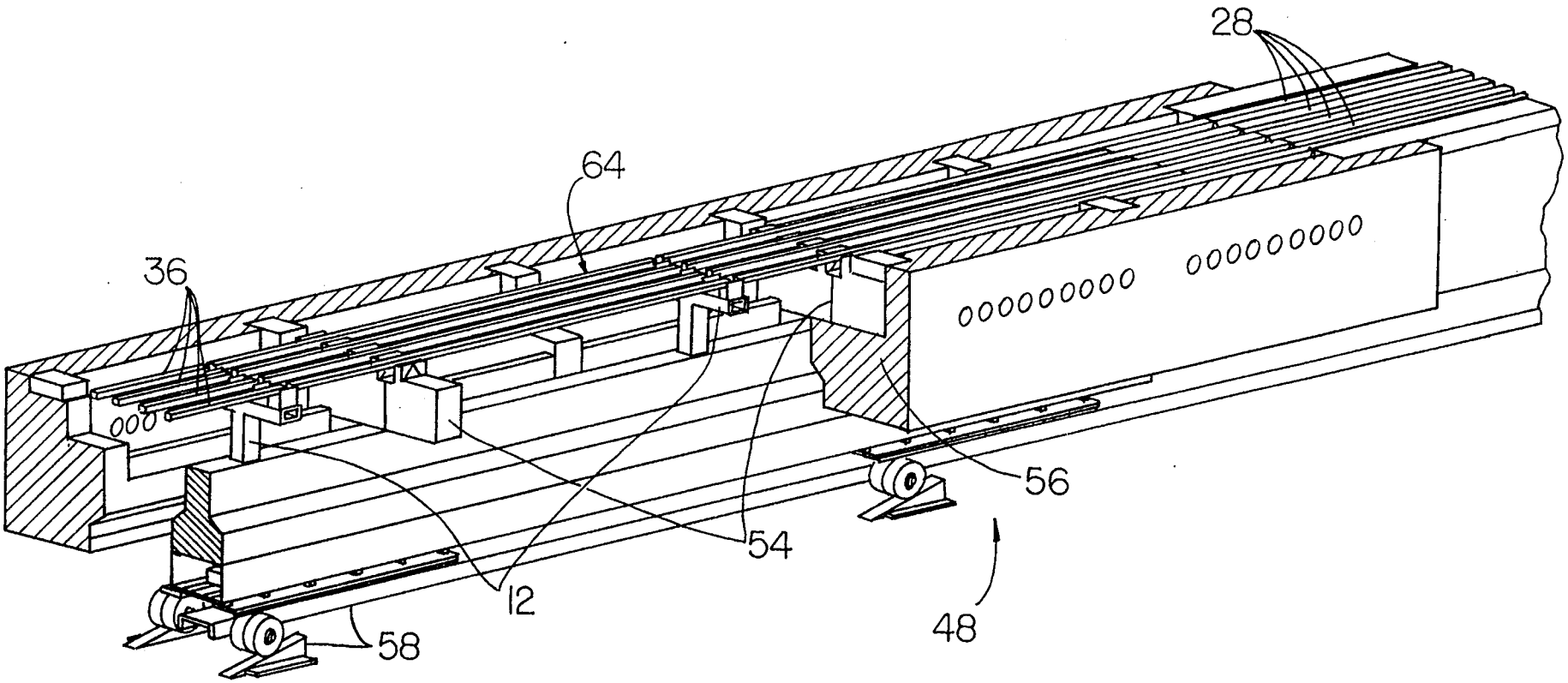
FIG. 5 is a perspective cut-away view of a portion of the furnace of FIG. 4 which illustrates the walking beam mechanism.

FIG. 5 is a perspective view of the walking beam furnace 48 that incorporates an extended walking beam mechanism 64. The cut-away portion illustrates the positioning of the hearth supports 54 with the hearth members 28 removed in the cut-away portion.

Although the invention has been shown and described with respect to exemplary embodiments thereof, various other changes, omissions and additions in form and detail thereof may be made therein without departing from the spirit and the scope of the invention.

We claim:

1. A walking beam furnace comprising:

a plurality of fixed hearth members in parallel, coplanar disposition, each said fixed hearth member separated from an adjacent fixed hearth member to form a plurality of parallel channels having a channel width; and a walking beam mechanism, including, a plurality of refractory ceramic beams in parallel, coplanar disposition aligned with said plurality of parallel channels, each said refractory ceramic beam having a beam width that is less than said channel width, permitting passage of said plurality of refractory ceramic beams through said plurality of channels without contacting any of said plurality of fixed hearth members, and a monolithic, refractory ceramic beam support, supporting said plurality of refractory ceramic beams and movable with respect to said plurality of fixed hearth members.

2. The walking beam furnace of claim 1, wherein each of said plurality of fixed hearth members comprises a planar surface having side elements projecting downwardly therefrom to define a cavity beneath said planar surface.

3. The walking beam furnace of claim 1, wherein each of said plurality of refractory ceramic beams are hollow.

4. The walking beam furnace of claim 1, wherein each of said plurality of ceramic beams has a planar upper surface.

5. The walking beam furnace of claim 1, wherein said monolithic, refractory ceramic beam support includes, a drive linkage adapted for coupling to a drive mechanism, and a beam retainer adapted to retain said plurality of refractory ceramic beams in fixed relation with said monolithic, refractory ceramic beam support.

6. The walking beam furnace of claim 5, wherein said beam retainer includes a plurality of positioning blocks secured thereto, each said positioning block adapted to secure one of said plurality of refractory ceramic beams in longitudinal alignment with another of said plurality of refractory ceramic beams.

7. The walking beam furnace of claim 6, wherein said drive linkage comprises a column oriented orthogonally to said beam retainer.

8. The walking beam furnace of claim 6, wherein said drive linkage and said beam retainer are hollow.

9. The walking beam furnace of claims 1, wherein said plurality of refractory ceramic beams and said monolithic, refractory ceramic beam support are fabricated from silicon carbide.

10. The walking beam furnace of claims 1, further including a hearth support having a plurality of alumina caps for supporting said plurality of fixed hearth members.

11. A walking beam furnace comprising:

a plurality of fixed hearth members in parallel, coplanar disposition, each said fixed hearth member separated from an adjacent fixed hearth member to form a plurality of parallel channels having a channel width, and each said fixed hearth member having a planar surface forming a fixed planar hearth;

a walking beam mechanism, including, a plurality of silicon carbide beams in parallel, coplanar disposition aligned with said plurality of parallel channels, each said silicon carbide beam having a beam width that is less than said channel width, permitting passage of said plurality of silicon carbide beams through said plurality of channels without contacting any of said plurality of fixed hearth members, and each said silicon carbide beam having a planar surface forming a movable planar hearth, said movable planar hearth parallel to said fixed planar hearth, and a monolithic, silicon carbide beam support, supporting said plurality of silicon carbide beams and movable with respect to said plurality of fixed hearth members.

12. The walking beam furnace of claim 11, wherein each of said plurality of fixed hearth members comprising a planar surface has side elements projecting downwardly therefrom to define a cavity beneath said planar surface.

13. The walking beam furnace of claim 11, wherein each of said plurality of silicon carbide beams are hollow.

14. The walking beam furnace of claim 11, wherein said monolithic, silicon carbide beam support includes, a drive linkage adapted for coupling to a drive mechanism, and a beam retainer adapted to retain said plurality of silicon carbide beams in fixed relation with said monolithic, silicon carbide beam support.

15. The walking beam furnace of claim 14, wherein said beam retainer includes a plurality of positioning blocks secured thereto, each said positioning block adapted to secure one of said plurality of silicon carbide beams in longitudinal alignment with another of said plurality of silicon carbide beams.

16. The walking beam furnace of claim 14, wherein said drive linkage comprises a column oriented orthogonally to said beam retainer.

17. The walking beam furnace of claim 14, wherein said drive linkage and said beam retainer are hollow.

* * * * *

UNITED STATES PATENT AND TRADEMARK OFFICE

CERTIFICATE OF CORRECTION

PATENT NO. : 5,334,014

DATED : August 2, 1994

INVENTOR(S) : Gary A. Orbeck, et al.

It is certified that error appears in the above-indentified patent and that said Letters Patent is hereby corrected as shown below:

In the Abstract, line 11, "the ,array" should read --the array--.

Column 2, line 57, "(SIC)," should read --SiC,--.

Signed and Sealed this

Eleventh Day of April, 1995

Bruce Lehman

*Attest:*

BRUCE LEHMAN

*Attesting Officer*

*Commissioner of Patents and Trademarks*